US010443168B2

(12) United States Patent
Fujihara

(10) Patent No.: US 10,443,168 B2
(45) Date of Patent: Oct. 15, 2019

(54) SEWING MACHINE

(71) Applicant: BROTHER KOGYO KABUSHIKI KAISHA, Nagoya-shi, Aichi-ken (JP)

(72) Inventor: Shinya Fujihara, Obu (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 84 days.

(21) Appl. No.: 15/714,855

(22) Filed: Sep. 25, 2017

(65) Prior Publication Data

US 2018/0010275 A1 Jan. 11, 2018

Related U.S. Application Data

(63) Continuation of application No. PCT/JP2016/068518, filed on Jun. 22, 2016.

(30) Foreign Application Priority Data

Sep. 15, 2015 (JP) ..... 2015-181522

(51) Int. Cl.
*D05B 59/00* (2006.01)
*D05B 43/00* (2006.01)
*D05B 47/00* (2006.01)

(52) U.S. Cl.
CPC ..... *D05B 59/00* (2013.01); *D05B 43/00* (2013.01); *D05B 47/00* (2013.01)

(58) Field of Classification Search
CPC ..... D05B 59/00; D05B 27/00; D05B 29/06; D05B 43/00; D05B 47/00; D05B 55/00
See application file for complete search history.

(56) References Cited

U.S. PATENT DOCUMENTS 1,848,352 A * 3/1932 Kelso ..... D05B 59/00 242/484.8
2,056,829 A * 10/1936 Colegrove ..... D05B 59/00 112/258

(Continued)

FOREIGN PATENT DOCUMENTS

JP S31-242 Y 1/1956
JP 2008-284057 A 11/2008

(Continued)

OTHER PUBLICATIONS

Mar. 20, 2018 International Preliminary Report on Patentability issued in International Patent Application No. PCT/JP2016/068518.

(Continued)

*Primary Examiner* — Danny Worrell
(74) *Attorney, Agent, or Firm* — Oliff PLC

(57) ABSTRACT

A sewing machine includes an arm portion, a thread spool mounting portion, a bobbin winder, a first guide portion, a second guide portion, and a partition wall member. The arm portion is provided with a drive shaft extending in a first direction. The thread spool mounting portion includes a thread spool pin to be inserted through a through hole of a thread spool. The bobbin winder is provided further to one end side of the arm portion than the thread spool mounting portion. The first guide portion is provided further to another end side of the arm portion than the thread spool mounting portion. The second guide portion is provided further to another end side in the first direction of the arm portion than the first guide portion. The partition wall member is disposed between the thread spool pin and the first guide portion in a second direction.

8 Claims, 16 Drawing Sheets

(56) References Cited

U.S. PATENT DOCUMENTS

| | | | | | |
|---|---|---|---|---|---|
| 2,432,138 | A * | 12/1947 | Colegrove | D05B 59/00 | 112/279 |
| 2,449,835 | A * | 9/1948 | Best | D05B 59/00 | 242/484.7 |
| 2,828,706 | A * | 4/1958 | Herbst | D05B 59/00 | 112/279 |
| 2,840,022 | A * | 6/1958 | Hamlett | D05B 59/00 | 112/279 |
| 3,665,875 | A * | 5/1972 | Bantor | D05B 59/00 | 112/279 |
| 4,211,373 | A * | 7/1980 | Papajewski | D05B 51/00 | 112/279 |
| 4,503,793 | A * | 3/1985 | Odermann | D05B 59/00 | 112/221 |
| 5,816,512 | A * | 10/1998 | Nakashima | D05B 59/00 | 242/484.7 |
| 7,905,189 | B2 * | 3/2011 | Wakazono | D05B 59/00 | 112/279 |
| 2009/0050039 | A1 | 2/2009 | Wakazono | | |
| 2010/0147989 | A1 * | 6/2010 | Fukao | B65H 54/12 | 242/484.7 |
| 2010/0154694 | A1 * | 6/2010 | Cho | D05B 59/00 | 112/470.01 |
| 2018/0010275 | A1 * | 1/2018 | Fujihara | D05B 43/00 | |

FOREIGN PATENT DOCUMENTS

| | | | |
|---|---|---|---|
| JP | 2010-029390 | A | 2/2010 |
| JP | 2013-184016 | A | 9/2013 |

OTHER PUBLICATIONS

Sep. 13, 2016 International Search Report issued in International Patent Application No. PCT/JP2016/068518.

* cited by examiner

SEWING MACHINE

CROSS-REFERENCE TO RELATED APPLICATION

This application is a continuation application of International Application No. PCT/JP2016/068518, filed Jun. 22, 2016, which claims priority from Japanese Patent Application No. 2015-181522, filed on Sep. 15, 2015. The disclosure of the foregoing application is hereby incorporated by reference in its entirety.

BACKGROUND

The present disclosure relates to a sewing machine that sews a sewing object.

A sewing machine is known that is provided with a bobbin winding device that winds a thread drawn out from a thread spool onto a lower thread bobbin. A bobbin winder spindle of the bobbin winding device on which the lower thread bobbin is mounted is positioned to the right of a thread spool pin on which the thread spool is mounted. A thread guide body positioned to the left of the thread spool pin guides the thread drawn out from the thread spool to the bobbin winder spindle. At the time of sewing, the thread drawn out from the thread spool is guided to a sewing needle via a thread take-up lever or the like that is positioned on an opposite side to the bobbin winder spindle with respect to the thread spool pin.

SUMMARY

When a thread is pulled strongly by the thread take-up lever or the like at the time of sewing, there is a possibility that a thread disturbance may occur and the thread may become entangled with the thread guide body positioned to the left of the thread spool pin. When the sewing is performed in a state in which the thread is entangled with the thread guide body, a tension is applied to the thread and there is a possibility of occurrence of a thread breakage in the sewing machine.

Various embodiments of the broad principles derived herein provide a sewing machine capable of inhibiting a thread drawn out from a thread spool from becoming entangled with a thread guide body when sewing is performed.

Embodiments provide a sewing machine including an arm portion, a thread spool mounting portion, a bobbin winder, a first guide portion, a second guide portion, and a partition wall member. The arm portion is internally provided with a drive shaft extending in a first direction. The thread spool mounting portion is provided on the arm portion and includes a thread spool pin configured to be inserted through a through hole of a thread spool around which a thread is wound. The thread spool is mounted on the thread spool mounting portion. The bobbin winder is provided further to one end side in the first direction of the arm portion than the thread spool mounting portion, and is configured to wind the thread drawn out from the thread spool onto a bobbin. The first guide portion is provided further to another end side in the first direction of the arm portion than the thread spool mounting portion, and is configured to guide the thread drawn out from the thread spool to the bobbin winder. The second guide portion is provided further to the another end side in the first direction of the arm portion than the first guide portion, and is configured to guide the thread drawn out from the thread spool to a sewing needle mounted on a needle bar that is configured to move up and down in accordance with rotation of the drive shaft. The partition wall member is disposed between the thread spool pin and the first guide portion in a second direction that is orthogonal to the first direction.

BRIEF DESCRIPTION OF THE DRAWINGS

Embodiments will be described below in detail with reference to the accompanying drawings in which.

DETAILED DESCRIPTION

Figure 1:
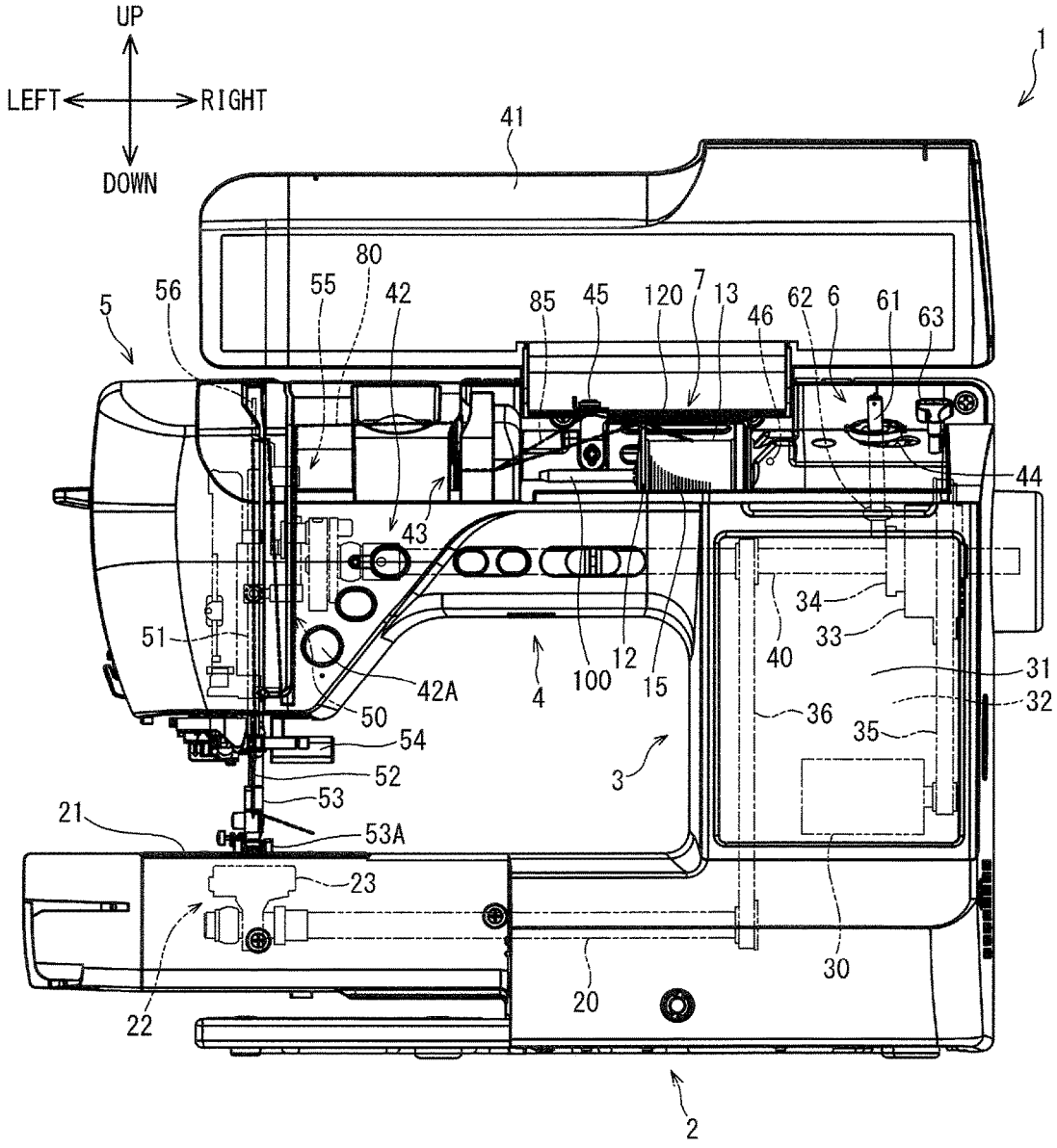
FIG. 1 is a front view of a sewing machine when sewing is performed.
Figure 2:
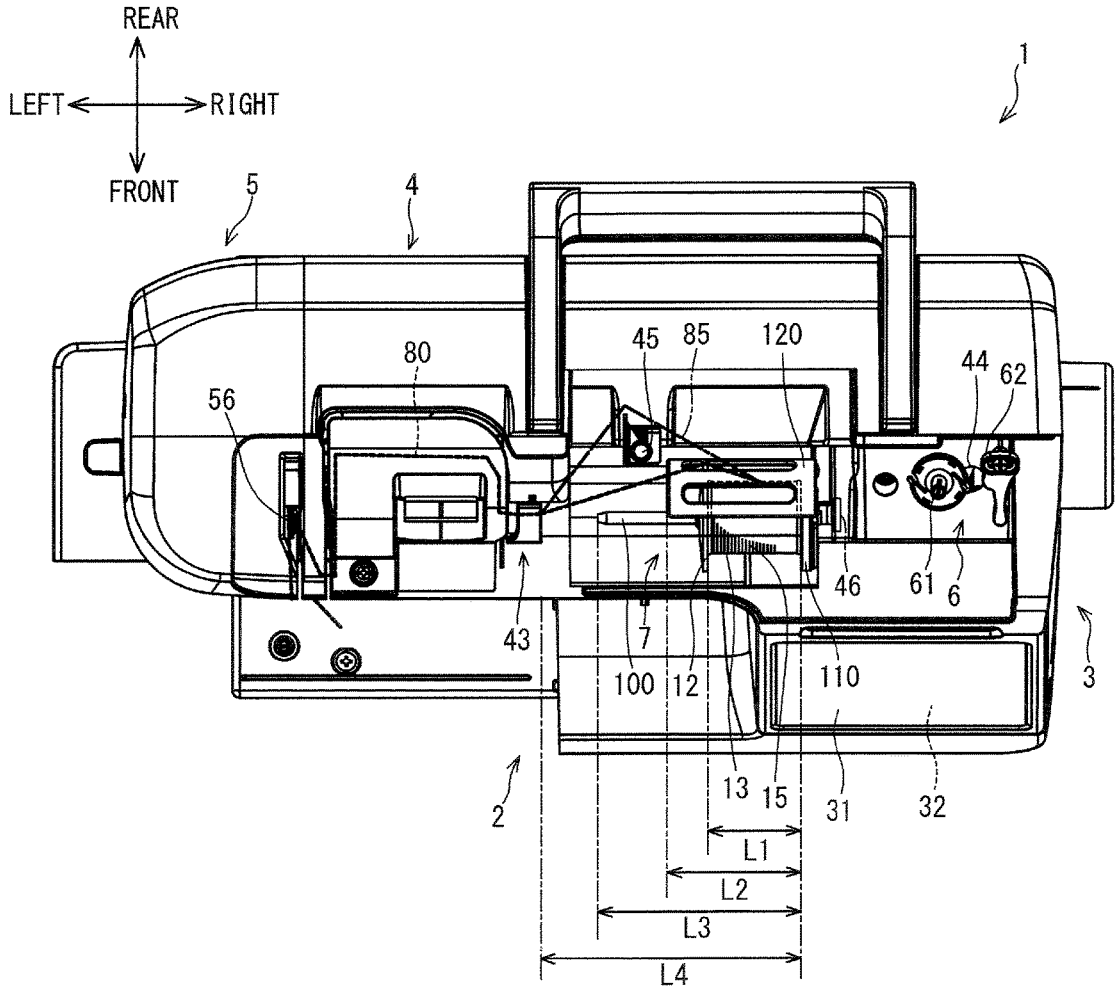
FIG. 2 is a plan view of the sewing machine when sewing is performed.

Hereinafter, an embodiment of the present disclosure will be explained with reference to the drawings. The drawings that are referred to are used to explain technological features that can be adopted by the present disclosure. Device structures illustrated in the drawings are not intended to limit the present disclosure to only those structures, and are merely explanatory examples. In the following explanation, the side (the near side in FIG. 1) on which a user who operates a sewing machine 1 according to the present disclosure is positioned is defined as the front side of the sewing machine 1, and its opposite side is defined as the rear side of the sewing machine 1. The side on which a pillar 3 is positioned is defined as the right side of the sewing machine 1, and the side on which a head portion 5 is positioned is defined as the left side of the sewing machine 1. As shown in FIG. 1 and FIG. 2, the sewing machine 1 is provided with a bed portion 2, the pillar 3, an arm portion 4 and the head portion 5. The bed portion 2 is a base portion of the sewing machine 1 and extends in the left-right direction. The pillar 3 is provided such that the pillar 3 stands upward from a right end portion of the bed portion 2. The arm portion 4 extends to the left from an upper portion of the pillar 3 such that the arm portion 4 faces the bed portion 2. The head portion 5 is a portion coupled to a left end portion of the arm portion 4.

A rectangular needle plate 21 is disposed on a top surface of the bed portion 2. A top surface of the needle plate 21 is substantially flush with the top surface of the of the bed portion 2. A work cloth (not shown in the drawings), which is a sewing target, is placed on the top surface of the bed portion 2 and the needle plate 21. The needle plate 21 is disposed below a needle bar 51 that is provided in the head portion 5. A needle hole (not shown in the drawings) that penetrates in a thickness direction of the needle plate 21 is formed in the needle plate 21. At the time of sewing, the tip of a sewing needle 52 mounted on the lower end of the needle bar 51 passes through the needle hole in accordance with an up and down movement of the needle bar 51.

A lower shaft 20 is provided inside the bed portion 2. The lower shaft 20 is driven to rotate by a drive shaft 40 provided inside the arm portion 4. A feed mechanism (not shown in the drawings), a shuttle mechanism 22 and the like are provided inside the bed portion 2 below the needle plate 21. The feed mechanism is a mechanism to drive a feed dog (not shown in the drawings). At the time of sewing, the feed dog clamps the work cloth between itself and a presser foot 53A, and feeds the work cloth. The shuttle mechanism 22 rotationally drives a shuttle 23 that is disposed inside the bed portion 2 and below the needle bar 51. The shuttle 23 houses a bobbin 19 (refer to FIG. 11) around which a lower thread is wound. The shuttle mechanism 22 is a mechanism having a known structure, and works in concert with the sewing needle 52 to form stitches on the work cloth.

An LCD 31 is provided on the front surface of the pillar 3. The LCD 31 has a rectangular shape that extends in the up-down direction in a front view. A screen including various items, such as commands, illustrations, setting values, messages and the like, is displayed on the LCD 31. A touch panel 32 is provided on the front side of the LCD 31. The touch panel 32 receives an input of an operation using a finger, a dedicated touch pen or the like. A timing pulley 33, a sewing machine motor 30, a control portion (not shown in the drawings) and the like are provided inside the pillar 3. The timing pulley 33 is connected to a right end portion of the drive shaft 40 via a clutch mechanism 34. The clutch mechanism 34 transmits a rotational driving force of the timing pulley 33 to the drive shaft 40. In accordance with an arrangement position of a bobbin winder spindle 61 (to be described later), the clutch mechanism 34 switches the timing pulley 33 and the drive shaft 40 between a connected state and a non-connected state. The sewing machine motor 30 is provided in a bottom portion of the pillar 3. A timing belt 35 is stretched between a driving shaft of the sewing machine motor 30 and the timing pulley 33. When the clutch mechanism 34 connects the timing pulley 33 and the drive shaft 40, the sewing machine motor 30 rotationally drives the drive shaft 40. The drive shaft 40 and the lower shaft 20 are connected by a timing belt 36. The rotation of the drive shaft 40 is transmitted to the lower shaft 20. The drive shaft 40 and the lower shaft 20 rotate in synchronization with each other.

A cover 41 that can be opened and closed is provided on an upper portion of the arm portion 4. Note that, in FIG. 1, the cover 41 is in an open state and in FIG. 2, the cover 41 has been removed from the arm portion 4. When the cover 41 is closed, a thread spool mounting portion 7 is provided on a top surface of the arm portion 4 and below the cover 41. A thread spool 13 (refer to FIG. 3), around which a thread 15 is wound, is mounted on the thread spool mounting portion 7. The thread 15 is wound around the thread spool 13 such that the thread 15 is dispersed in an extending direction of a through hole 14. At the time of sewing, the thread 15 is supplied as an upper thread to the sewing needle 52 mounted on the needle bar 51, via a sewing path 80 formed in the arm portion 4 and the head portion 5. The thread spool mounting portion 7 will be described later.

A bobbin winder 6 is provided on a right end portion of the arm portion 4, at a position on the right side of the thread spool mounting portion 7. The bobbin winder 6 is provided with the bobbin winder spindle 61 that extends substantially in the up-down direction. The bobbin winder spindle 61 is exposed above the top surface of the arm portion 4 from the inside of the arm portion 4, via a long hole 44 formed in the top surface of the arm portion 4. At the time of bobbin winding, namely, when the thread 15 wound around the thread spool 13 is wound around the bobbin 19, the bobbin 19 is mounted on an exposed section of the bobbin winder spindle 61 that is exposed above the top surface of the arm portion 4. The long hole 44 extends in the left-right direction. The bobbin winder spindle 61 can move between a preparation position at the left end of the long hole 44 and a winding position at the right end of the long hole 44. When the bobbin winder spindle 61 is positioned at the preparation position, the clutch mechanism 34 switches the timing pulley 33 and the drive shaft 40 to the connected state, and transmits the driving force of the sewing machine motor 30 to the drive shaft 40. When the bobbin winder spindle 61 is positioned at the winding position, the clutch mechanism 34 switches the timing pulley 33 and the drive shaft 40 to the non-connected state, and does not transmit the driving force of the sewing machine motor 30 to the drive shaft 40.

The bobbin winder spindle 61 has a rubber ring 62 at a lower end portion thereof. At the time of bobbin winding, the bobbin winder spindle 61 on which the bobbin 19 has been mounted is moved to the winding position. When the bobbin winder spindle 61 is positioned at the winding position, the rubber ring 62 is in contact with the left side surface of the timing pulley 33. In accordance with the rotation of the timing pulley 33, the bobbin winder spindle 61 rotates around a vertical axis that extends in the up-and-down direction. The thread 15 wound around the thread spool 13 is supplied to the bobbin winder 6 via a bobbin winding path 70 (refer to FIG. 11) formed in the arm portion 4, and is wound around the bobbin 19. Hereinafter, the thread 15 after the thread 15 has been wound around the bobbin 19 is referred to as the lower thread.

The bobbin winder 6 is provided with a bobbin presser 63. The bobbin presser 63 is provided on the right side of the bobbin winder spindle 61 when the bobbin winder spindle 61 is disposed at the winding position. When a predetermined amount of the thread 15 is wound around the bobbin 19 at the time of bobbin winding, the bobbin presser 63 comes into contact with an outer peripheral surface of the wound thread 15. The bobbin presser 63 relatively presses the bobbin winder spindle 61 to the left via the thread 15 and the bobbin 19. As a result, the rubber ring 62 of the bobbin winder spindle 61 is moved to the left away from the left side surface of the timing pulley 33. The rotation of the bobbin winder spindle 61 is stopped and the bobbin winder 6 completes the bobbin winding.

A tensioner 45 is provided on the top surface of the arm portion 4, at a position on the rear left side of the thread spool mounting portion 7. At the time of bobbin winding, the tensioner 45 applies a tension to the thread 15 supplied from the thread spool 13 to the bobbin winder 6. A thread hook portion 43 is provided on the top surface of the arm portion 4, at a position on the left side of the thread spool mounting portion 7. The thread hook portion 43 is a portion that guides a path of the thread 15 at a position on the most upstream side of the sewing path 80 through which the thread 15 drawn out from the thread spool 13 passes at the time of sewing. The thread hook portion 43 also serves as a portion that guides the path of the thread 15 at a position on the most upstream side of the bobbin winding path 70 through which the thread 15 drawn out from the thread spool 13 passes at the time of bobbin winding. A plurality of operation switches 42 including a sewing start/stop switch 42A etc. are provided on a lower portion of the front surface of the arm portion 4.

The head portion 5 is a leading end portion of the arm portion 4. The head portion 5 is provided with the needle bar 51, a presser bar 53, a tensioner (not shown in the drawings), a needle bar drive mechanism 50, a thread take-up lever mechanism 55 and the like. The needle bar 51 and the presser bar 53 extend downward from a lower end portion of the head portion 5. The sewing needle 52 can be mounted on the lower end of the needle bar 51. A needle eye (not shown in the drawings), through which the upper thread is inserted, is formed in the sewing needle 52. The presser bar 53 moves up and down in accordance with an operation of an up-and-down lever 54. The presser foot 53A is mounted on a lower end portion of the presser bar 53. The presser foot 53A can be removed from the presser bar 53. The tensioner 45 is provided on an upper portion of the head portion 5. The tensioner 45 applies a tension to the thread 15 drawn out from the thread spool mounting portion 7, and supplies the thread 15 to the sewing needle 52 via the thread take-up lever mechanism 55. Hereinafter, the thread 15 drawn out from the thread spool 13 at the time of sewing is referred to as the upper thread. The needle bar drive mechanism 50 is a mechanism that causes the needle bar 51 to move up and down in accordance with the rotation of the drive shaft 40. The thread take-up lever mechanism 55 is driven along with the rotation of the drive shaft 40, and causes the thread take-up lever 56 to move up and down in synchronization with the up and down movement of the needle bar 51. At the time of sewing, the needle bar 51 works in concert with the shuttle 23 and causes the upper thread to be entwined with the lower thread pulled out from the bobbin 19 housed in the shuttle 23. The thread take-up lever 56 pulls the upper thread entwined with the lower thread up onto the needle plate 21.

Figure 3:
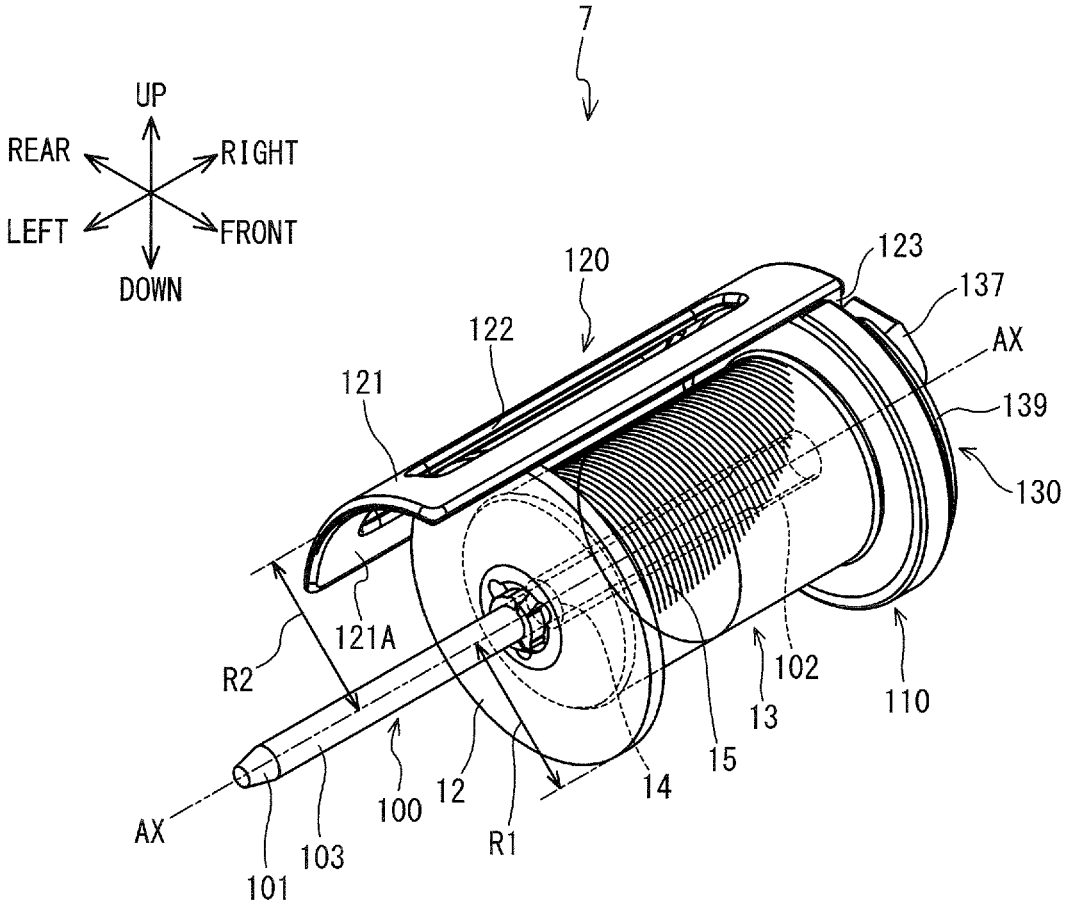
FIG. 3 is a perspective view of a thread spool mounting portion on which a thread spool and a thread spool retainer are mounted.
Figure 4:
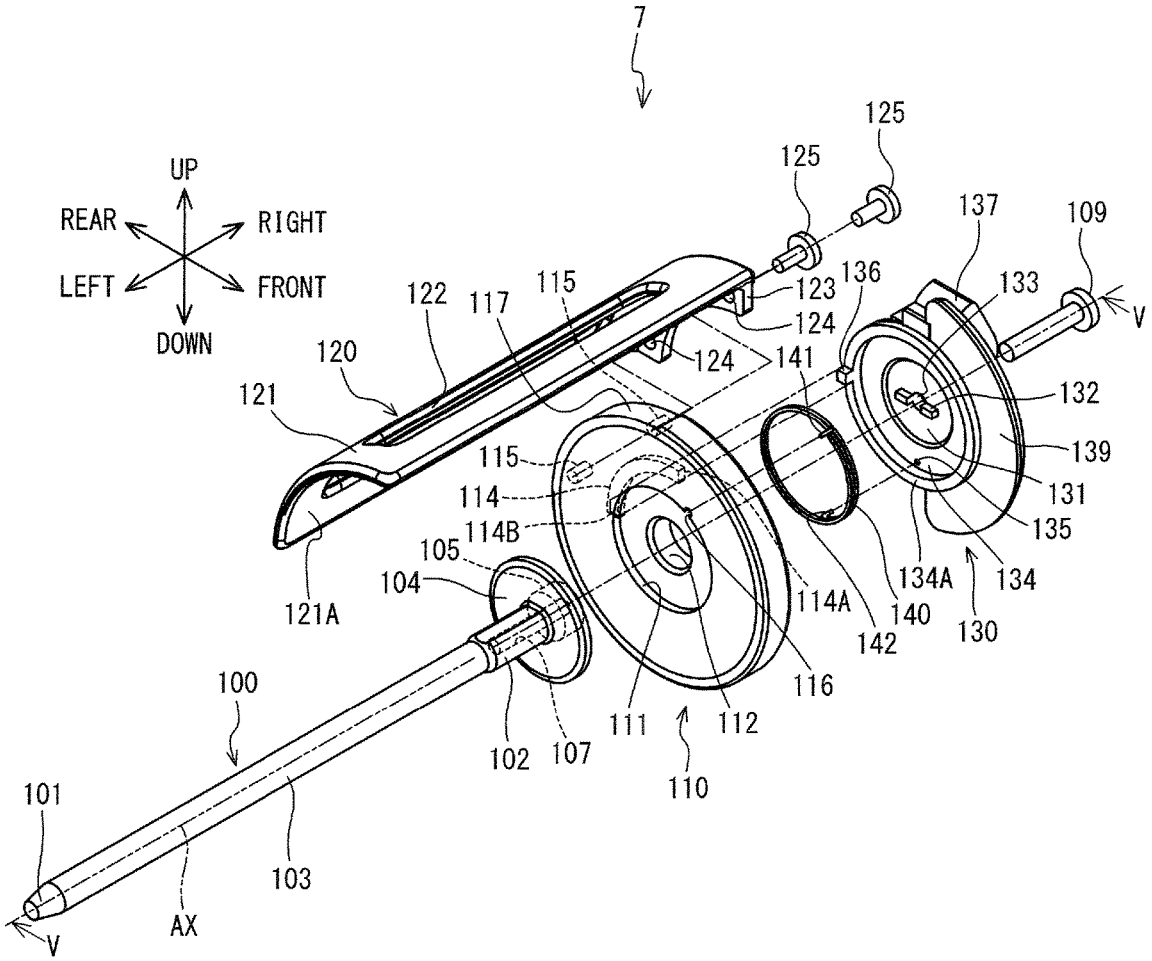
FIG. 4 is an exploded perspective view of the thread spool mounting portion.
Figure 5:
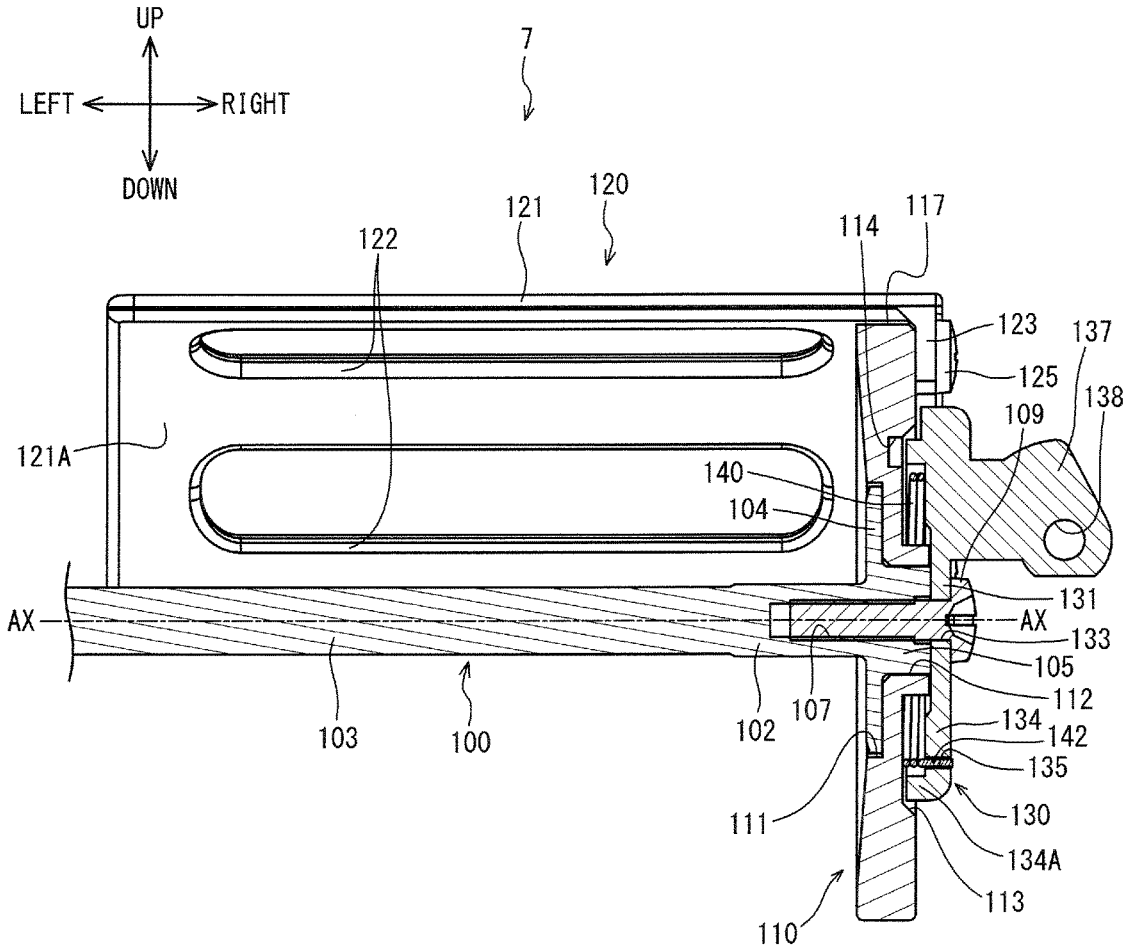
FIG. 5 is a cross-sectional view taken along a line V-V shown in FIG. 4, including an axial line AX of the thread spool mounting portion.
Figure 6:
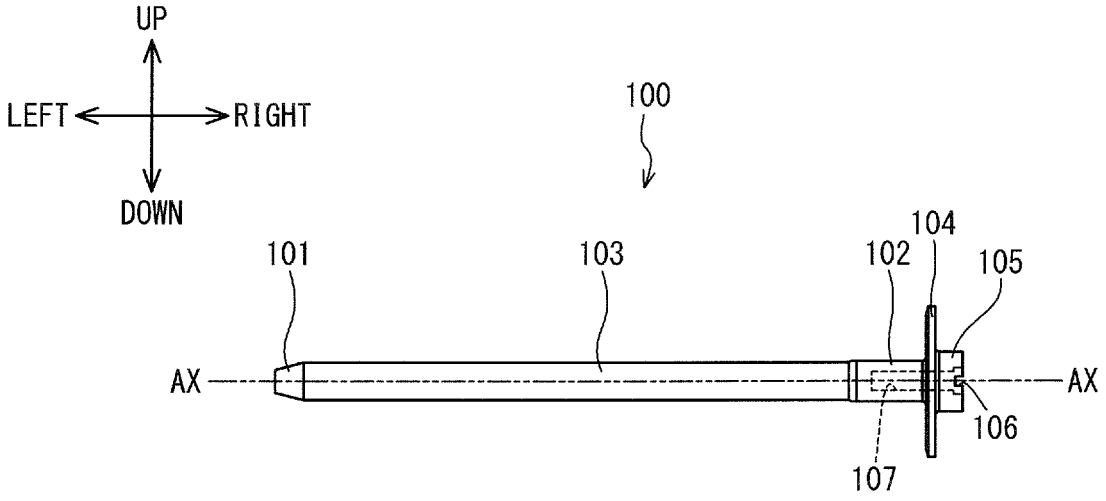
FIG. 6 is a front view of a thread spool pin.
Figure 7:
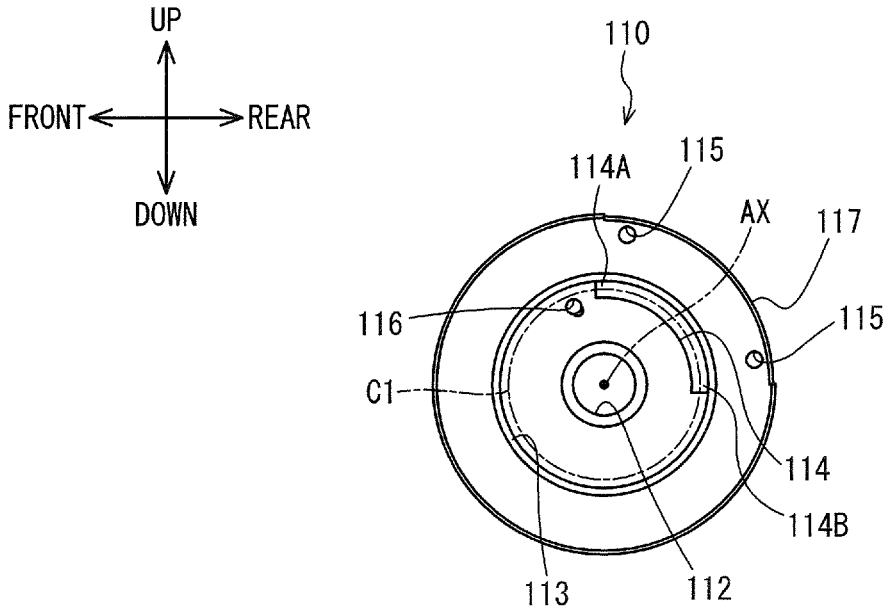
FIG. 7 is a right side view of a seat portion.
Figure 8:
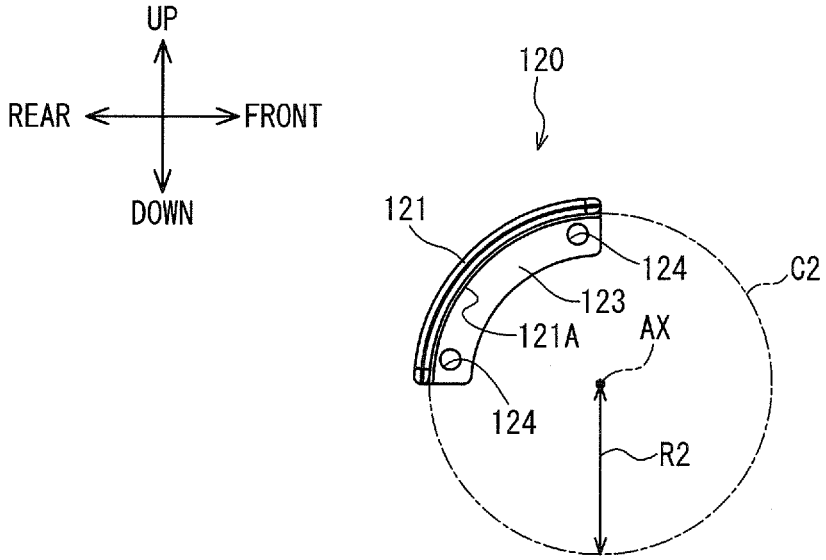
FIG. 8 is a left side view of a partition wall member.
Figure 9:
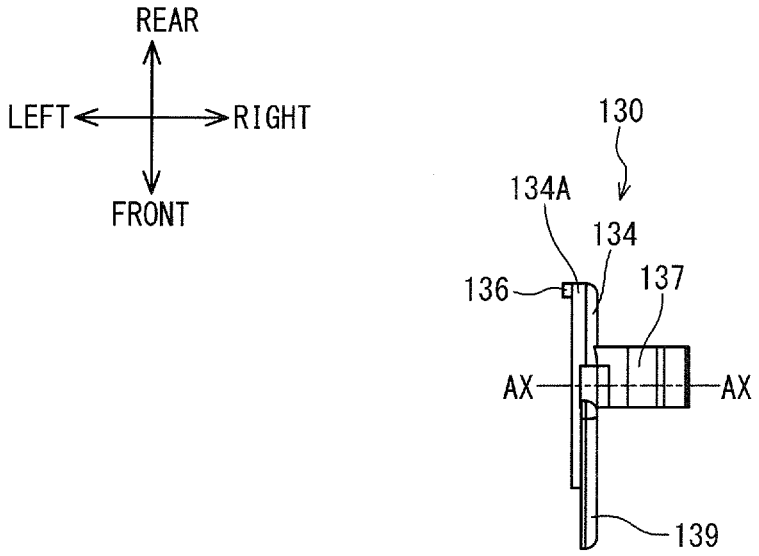
FIG. 9 is a plan view of a thread spool stand.

The structure of the thread spool mounting portion 7 will be explained with reference to FIG. 3 to FIG. 10. Directions of respective portions of the thread spool mounting portion 7 are defined as the up-down direction, the left-right direction and the front-rear direction, taking as a reference the direction of the sewing machine 1 in a state in which the thread spool mounting portion 7 is assembled on the sewing machine 1 (refer to FIG. 1). As shown in FIG. 3 to FIG. 5, the thread spool mounting portion 7 is provided with a thread spool pin 100, a seat portion 110, a partition wall member 120, a thread spool stand 130 and a spring 140.

As shown in FIG. 3 to FIG. 6, the thread spool pin 100 has a round bar shape that extends long along an axial line AX. At the time of sewing and at the time of bobbin winding, the axial line AX is arranged along the left-right direction of the sewing machine 1. A leading end portion 101 of the thread spool pin 100 is arranged on the left end side and a base end portion 102 of the thread spool pin 100 is arranged on the right end side. The leading end portion 101 is formed in a tapered shape. The outer diameter of the base end portion 102 is formed to be larger than that of a body portion 103 located between the leading end portion 101 and the base end portion 102. The right end of the base end portion 102 is provided with a disc-shaped collar portion 104 whose outer diameter is larger than that of the base end portion 102. The right surface of the collar portion 104 is provided with a columnar shaft portion 105 that protrudes to the right along the axial line AX. A fixing groove 106 and a screw hole 107 are formed in the shaft portion 105. The screw hole 107 is open on the right side of the shaft portion 105, and extends from the inside of the shaft portion 105 to the inside of the base end portion 102 along the axial line AX. The fixing groove 106 is provided in the right surface of the shaft portion 105 and extends in the front-rear direction.

As shown in FIG. 3 to FIG. 5 and FIG. 7, the seat portion 110 has a circular plate shape and is thick in the direction along the axial line AX. The outer diameter of the seat portion 110 is larger than the outer diameter of the thread spool 13 that is able to be mounted on the thread spool mounting portion 7. The seat portion 110 is formed with a left surface concave portion 111, a hole 112, a right surface concave portion 113, a guide groove 114, a pair of screw holes 115, a retaining hole 116 and a step portion 117. The left surface concave portion 111 is provided at the center of the left surface of the seat portion 110 and is formed in a circular shape. The collar portion 104 of the thread spool pin 100 is engaged with the left surface concave portion 111. The hole 112 is provided at the center of the left surface concave portion 111 and penetrates the seat portion 110 along the axial line AX. The shaft portion 105 of the thread spool pin 100 is engaged with the hole 112. The right surface concave portion 113 is provided in the right surface of the seat portion 110 and is formed in a circular shape. An inner peripheral surface of the right surface concave portion 113 is formed in a tapered shape. The inner diameter of the right surface concave portion 113 is larger than the inner diameter of the left surface concave portion 111. The guide groove 114 is a groove-shaped concave portion. The guide groove 114 extends in an arc shape around the axial line AX, between a first end portion 114A positioned at the upper edge of the inside of the right surface concave portion 113 and a second end portion 114B positioned at the rear edge. The length of the guide groove 114 is approximately one-fourth of the length of the circumference of a virtual circle C1 (refer to FIG. 7) centered on the axial line AX. One of the pair of screw holes 115 is provided in the right surface of the seat portion 110, in a position above and to the rear of the first end portion 114A of the guide groove 114. The other of the pair of screw holes 115 is provided in a position above and to the rear of the second end portion 114B. The retaining hole 116 is provided inside the right surface concave portion 113, in a position above the hole 112 and to the left of the first end portion 114A of the guide groove 114. The retaining hole 116 penetrates the seat portion 110. The step portion 117 is a portion formed by reducing the outer diameter of an outer peripheral surface of the seat portion 110. The step portion 117 is provided in the outer peripheral surface of the seat portion 110, in a section from the upper side to the rear side.

As shown in FIG. 3 to FIG. 5 and FIG. 8, the partition wall member 120 has a main body portion 121 and a collar portion 123. The partition wall member 120 extends from the thread spool stand 130 along an extending direction of the thread spool pin 100. The main body portion 121 has a rectangular plate shape that is long in the direction along the axial line AX. A cross section of the main body portion 121 that is orthogonal to the axial line AX has a circular arc shape. An inner peripheral surface 121A of the main body portion 121 is formed along a virtual circle C2 (refer to FIG. 8) with a radius R2 centered on the axial line AX. The length of the inner peripheral surface 121A in the circumference direction is approximately one-fourth of the length of the circumference of the virtual circle C2. The main body portion 121 extends along the axial line AX, and has two openings 122 each having an elongated hole shape and penetrating in a thickness direction of the main body portion 121. By providing the two openings 122, the weight of the partition wall member 120 is reduced. The collar portion 123 is formed in a flange shape, and protrudes from the right end of the main body portion 121 toward the axial line AX. The collar portion 123 has a plate shape that is orthogonal to the axial line AX and that extends in a circumferential direction of the axial line AX. A pair of holes 124 are formed at both ends of the collar portion 123. The pair of holes 124 each penetrate the collar portion 123 along the axial line AX. A pair of screws 125 are inserted through the pair of holes 124 from the right side of the collar portion 123. The pair of screws 125 are respectively tightened into the pair of screw holes 115 of the seat portion 110. A right end portion of the inner peripheral surface 121A of the main body portion 121 is engaged with the step portion 117 of the seat portion 110. The partition wall member 120 and the seat portion 110 are fixed integrally by the pair of screws 125.

As shown in FIG. 3 to FIG. 5 and FIG. 9, the thread spool stand 130 is a stand for fixing the thread spool pin 100. The thread spool stand 130 is formed with a fixing portion 131, a fixing protrusion 132, a hole 133, a housing portion 134, a retaining hole 135, a guide protrusion 136, a support portion 137, a shaft hole 138 and a blind plate 139. The housing portion 134 is formed in a circular plate shape orthogonal to the axial line AX. An edge portion 134A of the housing portion 134 protrudes to the left over the entire periphery. The outer diameter of the housing portion 134 is substantially the same as or slightly smaller than the inner diameter of the right surface concave portion 113 of the seat portion 110. The circular fixing portion 131 is provided at a center portion of the left surface of the housing portion 134. The fixing portion 131 is formed to be recessed in a stepped manner in the left surface of the housing portion 134. The hole 133 is formed at the center of the fixing portion 131. The hole 133 penetrates the fixing portion 131 along the axial line AX. The fixing protrusion 132 is provided on the left surface of the fixing portion 131. The fixing protrusion 132 protrudes to the left. When viewed from the left side, the fixing portion 123 extends in the front-rear direction such that the formation position of the hole 133 is at the midpoint of the fixing protrusion 132. The fixing protrusion 132 is engaged with the fixing groove 106 provided in the shaft portion 105 of the thread spool pin 100.

The retaining hole 135 is provided inside the housing portion 134 and below the fixing portion 131. The retaining hole 135 penetrates the housing portion 134. The guide protrusion 136 is provided on a section, of the edge portion 134A of the housing portion 134, positioned at the rear end of the housing portion 134. The guide protrusion 136 protrudes to the left from the edge portion 134A. The support portion 137 is provided on the right surface of the fixing portion 131 and above the hole 133, and protrudes to the right. The support portion 137 has the shaft hole 138 that penetrates in the front-rear direction. A shaft rod 46 (refer to FIG. 1 and FIG. 2), which is provided on the top surface of the arm portion 4 of the sewing machine 1, is inserted through the shaft hole 138. The shaft rod 46 is disposed such that axial center of the shaft rod 46 is directed in the front-rear direction. The thread spool stand 130 is attached to the top surface of the arm portion 4 such that the thread spool stand 130 can swing around the shaft rod 46. The blind plate 139 protrudes in a flange shape upward, forward and downward from an outer peripheral section of the housing portion 134. The blind plate 139 has a semicircular plate shape in a left side view. The outer diameter of the blind plate 139 is slightly smaller than the outer diameter of the seat portion 110 and larger than the inner diameter of the right surface concave portion 113 of the seat portion 110.

The thread spool stand 130 is disposed on the right side of the seat portion 110. The left surface of the housing portion 134 is disposed facing the right surface of the right surface concave portion 113 of the seat portion 110. The right surface of the right surface concave portion 113, the left surface of the housing portion 134 and an inner peripheral surface of the edge portion 134A form a housing chamber that houses the spring 140. One end of the spring 140 is folded to the left and forms a latching portion 141. The latching portion 141 is engaged with the retaining hole 116 provided inside the right surface concave portion 113 of the seat portion 110. The other end of the spring 140 is folded to the right and forms a latching portion 142. The latching portion 142 is engaged with the retaining hole 135 provided inside the housing portion 134 of the thread spool stand 130. The guide protrusion 136 of the thread spool stand 130 is engaged with the guide groove 114 formed inside the right surface concave portion 113 of the seat portion 110. A screw 109 is inserted through the hole 133 of the fixing portion 131 from the right side of the fixing portion 131. The screw 109 is tightened into the screw hole 107 provided in the shaft portion 105 of the thread spool pin 100 that is engaged with the hole 112 of the seat portion 110. Since the fixing protrusion 132 of the thread spool stand 130 is engaged with the fixing groove 106 of the thread spool pin 100, the thread spool stand 130 and the thread spool pin 100 are fixed integrally. The seat portion 110 is rotatably supported by the shaft portion 105 of the thread spool pin 100. A rotation range of the seat portion 110 is a range within which the guide protrusion 136 of the thread spool stand 130 moves between the first end portion 114A and the second end portion 114B of the guide groove 114. Since the length of the guide groove 114 is approximately one-fourth of the length of the circumference of the virtual circle C1 (refer to FIG. 7), the seat portion 110 can rotate within a range of approximately 90 degrees with respect to the thread spool stand 130.

The main body portion 121 of the partition wall member 120 has the circular arc-shaped cross section that is orthogonal to the axial line AX. Therefore, even when the seat portion 110 rotates with respect to the thread spool stand 130, in the cross section of the main body portion 121 that includes the axial line AX, the size of a region occupied by the outer shape of the main body portion 121 does not change.

As shown in FIG. 2, a length L2 by which the left end of the main body portion 121 of the partition wall member 120 protrudes in the axial line AX direction from the left surface of the seat portion 110 is longer than a length L1 in the axial line AX direction of the thread spool 13 that is able to be mounted on the thread spool mounting portion 7. In other words, when the thread spool 13 is mounted on the thread spool mounting portion 7, the left end of the partition wall member 120 is positioned further to the left than the left end of the thread spool 13. Therefore, when the length L2 of the partition wall member 120 is longer than the length L1 of the thread spool 13, if the thread 15 drawn out from the thread spool 13 becomes slack outwardly in the radial direction of the axial line AX, the partition wall member 120 can come into contact with the thread 15 and it is easy to suppress thread disturbance of the thread 15.

The length L2 of the partition wall member 120 is shorter than a length L3 by which the left end of the thread spool pin 100 protrudes from the left surface of the seat portion 110. The length L2 of the partition wall member 120 is, for example, equal to or more than two-thirds of the length L3 of the thread spool pin 100. The length L3 of the thread spool pin 100 is designed to be approximately twice the length L1 of the thread spool 13. Therefore, when the length L2 of the partition wall member 120 is equal to or more than two-thirds of the length L3 of the thread spool pin 100, if the thread 15 drawn out from the thread spool 13 becomes slack outwardly in the radial direction of the axial line AX, the partition wall member 120 can come into contact with the thread 15 and the partition wall member 120 is easy to suppress the thread disturbance of the thread 15.

The thread spool mounting portion 7 configured as described above is assembled on the sewing machine 1 such that the shaft rod 46 provided on the top surface of the sewing machine 1 is inserted into the shaft hole 138 of the support portion 137 of the thread spool stand 130. The thread spool mounting portion 7 allows the leading end portion 101 side of the thread spool pin 100 to swing in the up-down direction, with the shaft rod 46 serving as an axis. The support portion 137 is provided on the right side of the fixing portion 131 and above the hole 133. Therefore, when no external stress is applied, the thread spool mounting portion 7 rotates around the shaft rod 46 due to a gravitational force such that the leading end portion 101 side of the thread spool pin 100 is directed downward. A wall portion (not shown in the drawings) that is directed to the left is provided on a section, of the top surface of the sewing machine 1, to which the thread spool mounting portion 7 is attached. When the leading end portion 101 side of the thread spool pin 100 rotates downward, the right surface of the thread spool stand 130 comes into contact with the wall portion. Thus, the thread spool mounting portion 7 is arranged on the top surface of the sewing machine 1 in a state in which the axial line AX is directed in the left-right direction. The arrangement position of the thread spool mounting portion 7 when the axial line AX of the thread spool pin 100 is along the left-right direction is referred to as a "fifth position."

When the thread spool 13 is mounted on the thread spool mounting portion 7, the thread spool mounting portion 7 rotates such that the leading end portion 101 side of the thread spool pin 100 is directed upward. The thread spool mounting portion 7 can rotate approximately 45 degrees in the clockwise direction in a front view around the axial center of the shaft rod 46. The axial line AX is along an attachment/detachment direction that intersects at an angle of approximately 45 degrees in the left-right direction. The thread spool pin 100 is arranged such that the leading end portion 101 side is directed diagonally upward. The arrangement position of the thread spool mounting portion 7 when the axial line AX of the thread spool pin 100 is along the attachment/detachment direction is referred to as a "sixth position." The thread spool pin 100 is inserted, from the leading end portion 101 side, through the through hole 14 of the thread spool 13 around which the thread 15 has been wound. The thread spool 13 moves to the base end portion 102 side of the thread spool pin 100 along the axial line AX. The right end of the thread spool 13 comes into contact with the seat portion 110. The thread spool pin 100, on which the thread spool 13 has been mounted, is fitted into a thread spool retainer 12 from the leading end portion 101 side. The outer diameter of the thread spool retainer 12 is larger than the outer diameter of the thread spool 13. The thread spool retainer 12 holds the thread spool 13 so that the thread spool 13 does not come off from the thread spool pin 100. The thread spool retainer 12 has a size such that the thread spool retainer 12 does not come into contact with the inner peripheral surface 121A of the main body portion 121 of the partition wall member 120 in a state in which the thread spool retainer 12 is fitted onto the thread spool pin 100. A radius R1 of the thread spool retainer 12 centered on the axial line AX is smaller than the radius R2 of the virtual circle C2 (refer to FIG. 8) along which the inner peripheral surface 121A of the main body portion 121 extends (refer to FIG. 3). Therefore, the thread 15 drawn out from the thread spool 13 is not clamped between the inner peripheral surface 121A of the main body portion 121 of the partition wall member 120 and an outer peripheral surface of the thread spool retainer 12. Since unintended tension is unlikely to be applied to the thread 15, it is unlikely to affect the tension of the upper thread at the time of sewing.

The thread spool mounting portion 7 on which the thread spool 13 has been mounted rotates, in the counterclockwise direction in a front view, around the shaft rod 46 due to the gravitational force, and is disposed in the fifth position. The axial line AX is along the left-right direction. The seat portion 110 is urged relative to the thread spool stand 130 by the spring 140, in a direction in which the seat portion 100 rotates in the clockwise direction in a left side view. In accordance with the rotation of the seat portion 110, the guide protrusion 136 of the thread spool stand 130 relatively moves along the guide groove 114 toward the second end portion 114B. The guide protrusion 136 comes into contact with an inner wall of the guide groove 114 at the second end portion 114B, and stops the clockwise rotation of the seat portion 110 by the spring 140. Therefore, as shown in FIG. 3, when no external stress is applied, the partition wall member 120 fixed to the seat portion 110 is disposed in a "first position" in which the partition wall member 120 covers a section from the upper side to the rear side of the thread spool 13. When the partition wall member 120 is positioned in the first position, the main body portion 121 of the partition wall member 120 is orthogonal to the axial line AX, and is mainly positioned above the axial line AX in a direction orthogonal to the axial center of the shaft rod 46. As shown in FIG. 1 and FIG. 2, the partition wall member 120 positioned in the first position is disposed between the tensioner 45 and a section of the thread spool pin 100 at least from the base end portion 102 to the body portion 103. Therefore, the main body portion 121 of the partition wall member 120 is disposed between the thread spool pin 100 and the tensioner 45 in a direction orthogonal to the left-right direction, i.e., in a direction from the axial line AX of the thread spool pin 100 toward the tensioner 45 in a right side view.

The thread 15 drawn out from the thread spool 13 passes between the inner peripheral surface 121A of the partition wall member 120 and the outer peripheral surface of the thread spool retainer 12, and is hooked on the thread hook portion 43 positioned to the left of the thread spool mounting portion 7. The thread 15 that has passed through the thread hook portion 43 is supplied as the upper thread to the sewing needle 52 via the sewing path 80. At the time of sewing, the start/stop switch 42A is operated and the sewing machine motor 30 is driven. The sewing machine 1 activates the needle bar drive mechanism 50, the thread take-up lever mechanism 55 and the shuttle mechanism 22. The needle bar 51 and the shuttle 23 operate in concert with each other, and entwine the upper thread with the lower thread pulled out from the bobbin 19, thus forming stitches on the work cloth. In response to the operation of the start/stop switch 42A, the sewing machine 1 stops the sewing. At the time of sewing, the thread 15 drawn out from the thread spool 13 becomes free between the thread spool 13 and the thread hook portion 43. When the thread take-up lever 56 strongly pulls the thread 15, the thread 15 is forcibly drawn out from the thread spool 13 and there is a possibility that thread disturbance of the thread 15 may occur on the way to the thread hook portion 43. If the partition wall member 120 is not present, if the thread 15 becomes slack outwardly in the radial direction of the axial line AX between the thread spool 13 and the thread hook portion 43, there is a possibility that the thread 15 may pass through, for example, a path 85 and become entangled with the tensioner 45. In the first position, the partition wall member 120 is disposed between the tensioner 45 and the thread spool 13 mounted on the thread spool pin 100. The partition wall member 120 interrupts the movement of the thread 15 toward the tensioner 45 caused by the thread disturbance. The partition wall member 120 suppresses the thread disturbance of the thread 15 such that the thread 15 at least does not pass through the path 85, and guides the thread 15 toward the thread hook portion 43.

L2 is the length by which the left end of the main body portion 121 of the partition wall member 120 protrudes in the axial line AX direction from the left surface of the seat portion 110. L4 is a length between the thread hook portion 43 and the left surface of the seat portion 110 in the axial line AX direction. The length L2 is equal to or more than half the length L4 (refer to FIG. 2). In other words, the left end of the partition wall member 120 is positioned on the thread hook portion 43 side relative to a center position between the thread hook portion 43 and the left surface of the seat portion 110 in the axial line AX direction. When a section of the thread 15 wound on the right end of the thread spool 13 is drawn out, in comparison to when a section of the thread 15 wound on the left end of the thread spool 13 is drawn out, the length of a section of the thread 15 that becomes free between the position at which the thread 15 is drawn out from the thread spool 13 and the thread hook portion 43 becomes longer. In this case, if thread disturbance of the thread 15 occurs, the thread 15 is likely to be displaced significantly outwardly in the radial direction due to the slack at a substantial center position between the position at which the thread 15 is drawn out from the thread spool 13 and the thread hook portion 43. Since the length L2 of the partition wall member 120 is equal to or more than half the length L4, the left end of the partition wall member 120 is positioned between the tensioner 45 and the center position at which the thread 15 is slack in the above case, and it is possible to suppress the thread disturbance of the thread 15.

Figure 10:
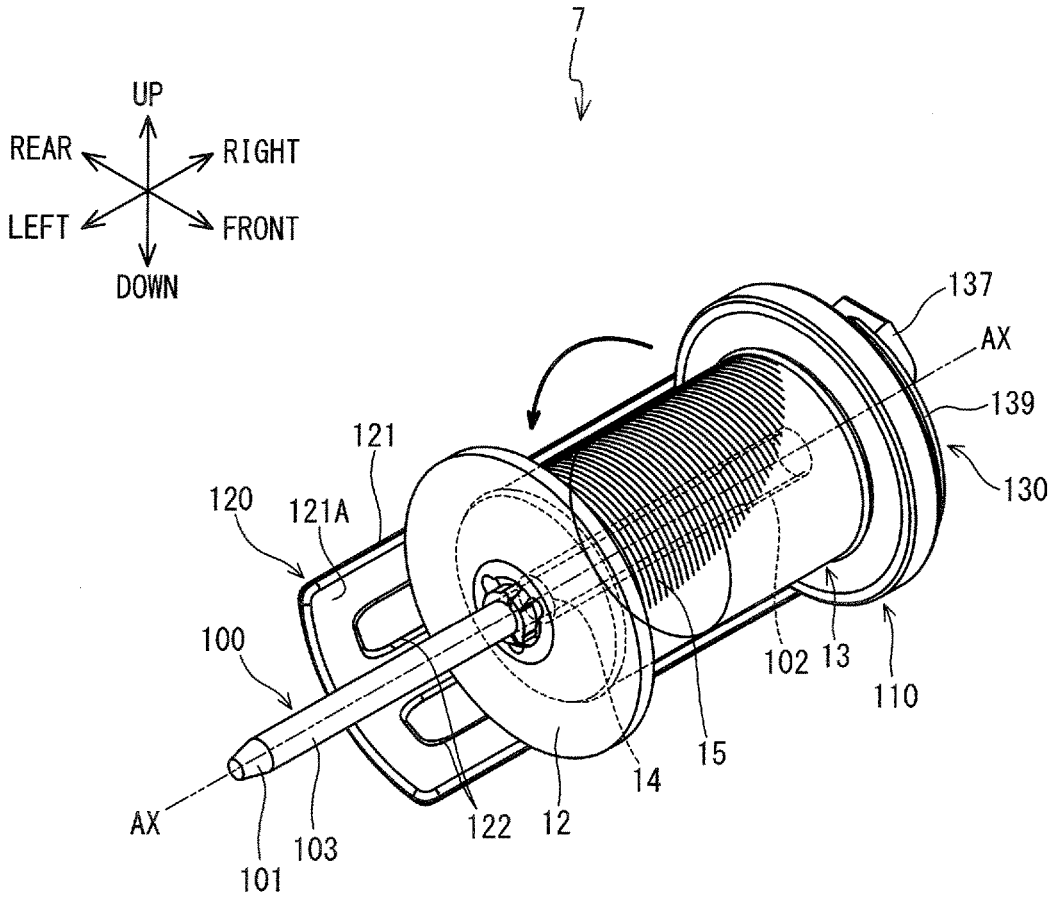
FIG. 10 is a perspective view of the thread spool mounting portion when the partition wall member is rotated in the counterclockwise direction in a left side view.

When the thread spool 13 is removed, the partition wall member 120 is pressed by a finger or the like of the operator, for example. When the main body portion 121 of the partition wall member 120 is pressed rearward and downward, the seat portion 110 rotates in the counterclockwise direction in a left side view, relative to the thread spool stand 130, in resistance to the urging force of the spring 140. In accordance with the rotation of the seat portion 110, the guide protrusion 136 relatively moves along the guide groove 114 toward the first end portion 114A. The guide protrusion 136 comes into contact with the inner wall of the guide groove 114 at the first end portion 114A, and stops the counterclockwise rotation of the seat portion 110 due to the external stress. The seat portion 110 rotates approximately 90 degrees with respect to the thread spool stand 130. As a result, as shown in FIG. 10, when the external stress is applied, the partition wall member 120 is disposed in a "second position" in which the partition wall member 120 covers a section from the rear side to the lower side of the thread spool 13. When the partition wall member 120 is positioned in the second position, the main body portion 121 of the partition wall member 120 is orthogonal to the axial line AX and is positioned mainly below the axial line AX in the direction orthogonal to the axial center of the shaft rod 46. The partition wall member 120 positioned in the second position exposes the thread spool 13 in a plan view. Thus, it is easy for the operator to grasp the thread spool 13 using his/her fingers or the like.

When the operator grasps and lifts up the thread spool 13, the thread spool mounting portion 7 rotates in the clockwise direction in a front view around the shaft rod 46, and is disposed in the sixth position. The thread spool pin 100 is brought into a state in which the leading end portion 101 side is directed diagonally upward. The axial line AX is along the attachment/detachment direction. The thread spool 13 is removed from the leading end portion 101 side of the thread spool pin 100 along the axial line AX. When the operator releases his/her hand, the thread spool mounting portion 7 rotates in the counterclockwise direction in a front view around the shaft rod 46 due to the gravitational force, and is disposed in the fifth position. In a state in which the axial line AX is directed in the left-right direction, the thread spool mounting portion 7 is disposed on the top surface of the sewing machine 1. When no external stress is applied to the partition wall member 120, the seat portion 110 rotates in the clockwise direction in a left side view due to the urging force of the spring 140. The guide protrusion 136 moves toward the second end portion 114B relative to the guide groove 114. The partition wall member 120 returns to the first position, and when the thread spool 13 is newly mounted, the partition wall member 120 covers a section from the upper side to the rear side of the thread spool 13.

Figure 11:
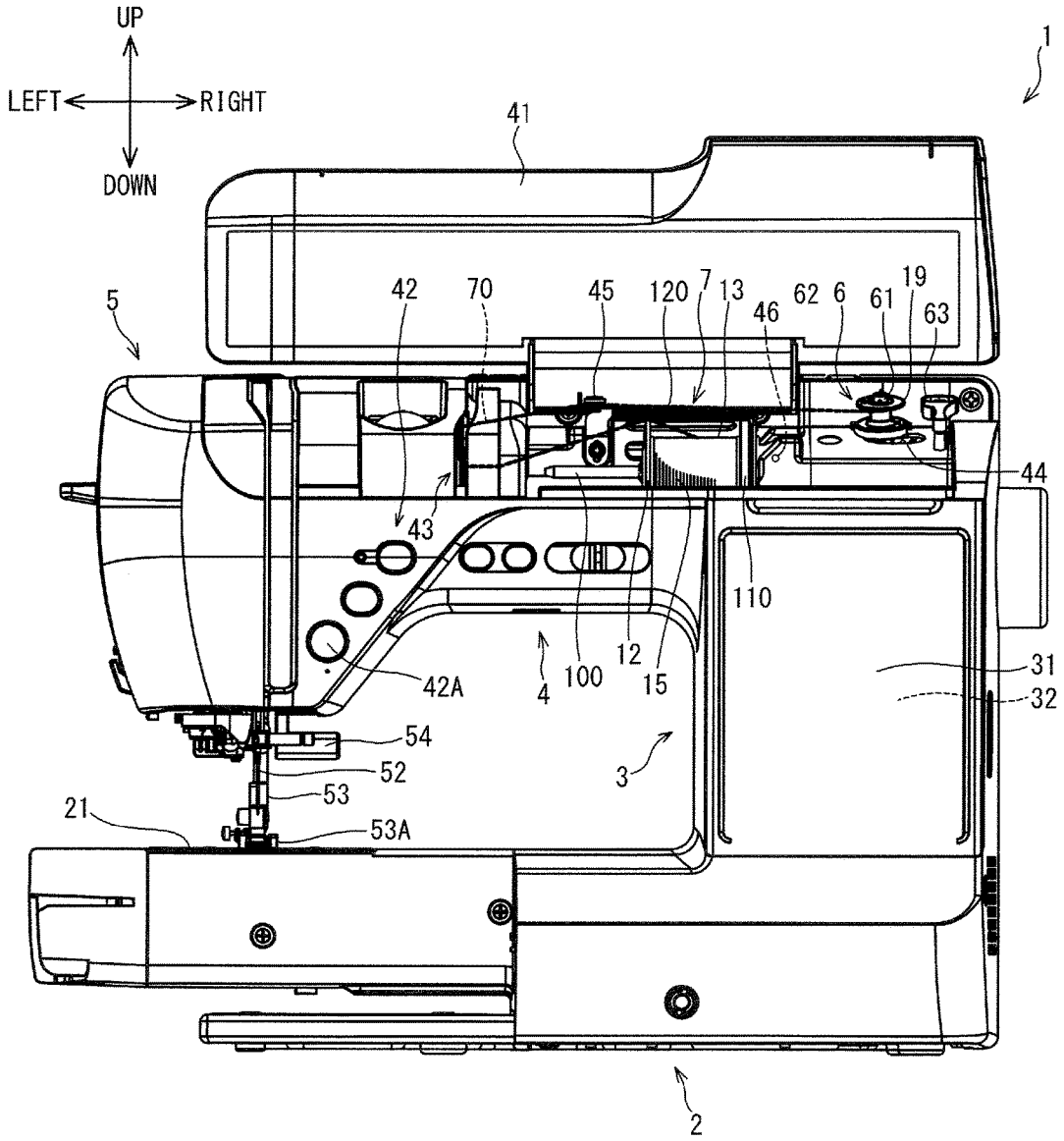
FIG. 11 is a front view of the sewing machine when a thread is wound.
Figure 12:
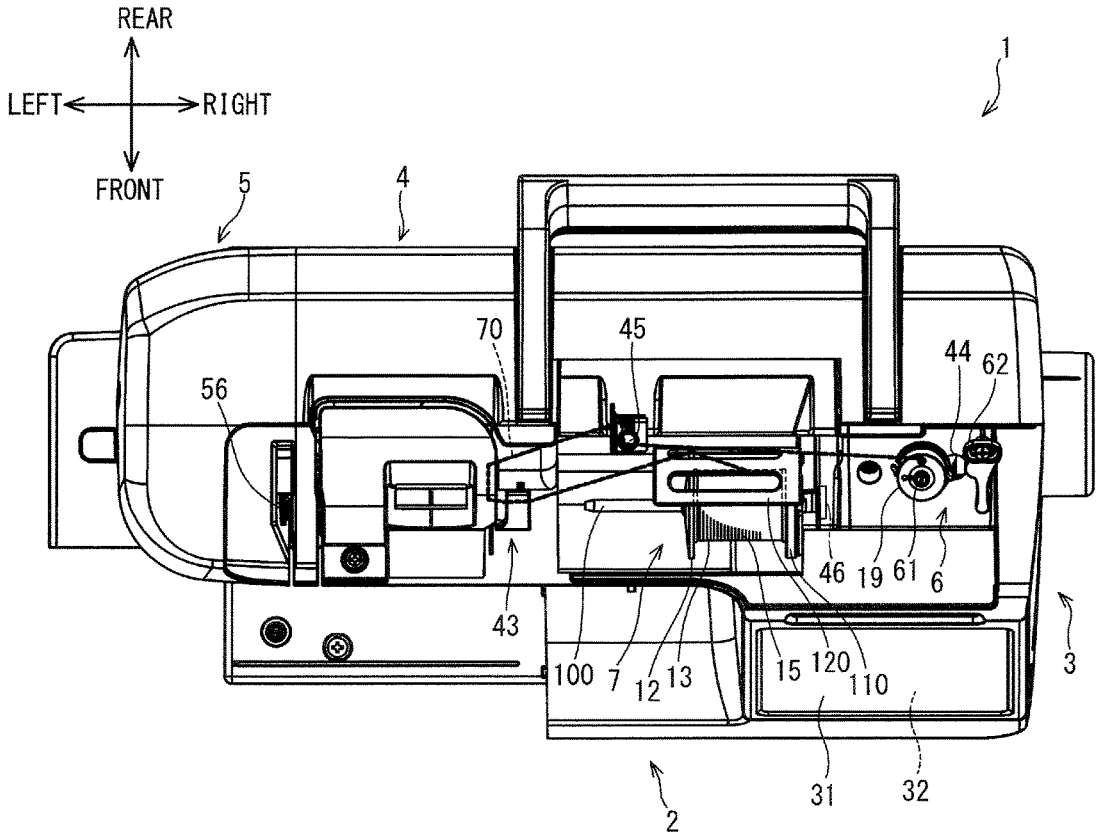
FIG. 12 is a plan view of the sewing machine when the thread is wound.

At the time of bobbin winding, the bobbin 19 is mounted on the bobbin winder spindle 61 of the bobbin winder 6, as shown in FIG. 11 and FIG. 12. In the same manner as at the time of sewing, the thread spool 13 is mounted on the thread spool mounting portion 7 disposed in the sixth position. The thread 15 drawn out from the thread spool 13 passes between the inner peripheral surface 121A of the partition wall member 120 and the outer peripheral surface of the thread spool retainer 12, and is hooked on the thread hook portion 43. The thread 15 that has passed through the thread hook portion 43 is guided to the tensioner 45 via the bobbin winding path 70. An end portion of the thread 15 that has passed through the tensioner 45 is held by the bobbin 19. When the bobbin winder spindle 61 is moved to the winding position, the clutch mechanism 34 causes the sewing machine motor 30 and the drive shaft 40 to be in a disconnected state.

When the start/stop switch 42A is operated and the sewing machine motor 30 is driven, the bobbin winder spindle 61 rotates the bobbin 19. The thread 15 drawn out from the thread spool 13 passes through the thread hook portion 43 and the tensioner 45, is guided to the bobbin 19 via the bobbin winding path 70, and is wound on the bobbin 19. At the time of bobbin winding, the partition wall member 120 is positioned in the first position and is disposed between the tensioner 45 and the thread spool 13 mounted on the thread spool pin 100. In the same manner as at the time of sewing, the partition wall member 120 suppresses the thread disturbance of the thread 15 and guides the thread 15 toward the thread hook portion 43. When a predetermined amount of the thread 15 is wound around the bobbin 19, the bobbin winder spindle 61 is pressed by the bobbin presser 63 and separates from the timing pulley 33, thus stopping the rotation. After the bobbin winding is completed and the thread 15 is cut, the bobbin 19, around which the thread 15 has been wound as the lower thread, is mounted in the shuttle 23. The bobbin winder spindle 61 is disposed in the preparation position. The thread 15 on the thread spool 13 is supplied to the sewing needle 52 via the sewing path 80. The sewing machine 1 is able to perform sewing.

As explained above, with the sewing machine 1 of the present embodiment, at the time of sewing, the thread 15 drawn out from the thread spool 13 is guided to the sewing needle 52 via the sewing path 80. When the thread 15 is strongly drawn out, the thread disturbance of the thread 15 may occur on the way from the thread spool 13 toward the thread hook portion 43. The partition wall member 120 disposed between the thread spool pin 100 and the tensioner 45 is positioned between the thread spool 13, through which the thread spool pin 100 is inserted, and the tensioner 45. The partition wall member 120 can suppress the thread disturbance of the thread 15 drawn out from the thread spool 13, and can inhibit the thread 15 from moving toward the tensioner 45. Thus, at the time of sewing, the sewing machine 1 can inhibit the thread 15 drawn out from the thread spool 13 from becoming entangled with the tensioner 45 and thus can inhibit thread breakage from occurring.

Since the partition wall member 120 is provided on the thread spool stand 130, the sewing machine 1 need not be provided with a component to fix the partition wall member 120 between the thread spool pin 100 and the tensioner 45. Thus, the sewing machine 1 can be provided with the partition wall member 120 using a simple structure, and at the time of sewing, it is possible to inhibit the thread 15 from becoming entangled with the tensioner 45.

The thread 15 is wound around the thread spool 13 such that the thread 15 is dispersed in the extending direction of the through hole 14. The partition wall member 120 can be positioned between the thread 15 and the tensioner 45, regardless of the position from which the thread 15 (to be drawn out from the thread spool 13) is drawn out in the extending direction of the through hole 14. Thus, at the time of sewing, the sewing machine 1 can inhibit the thread 15 from becoming entangled with the tensioner 45.

It is further preferable that the left end of the partition wall member 120 be positioned on the thread hook portion 43 side relative to the center position between the thread hook portion 43 and the left surface of the thread spool stand 130 in the direction along the axial line AX. When the thread 15 drawn out from the thread spool 13 becomes slack in the radial direction of the axial line AX, there is a possibility of thread disturbance of the thread 15 such that the thread 15 is displaced most outwardly in the radial direction at the center position between the position at which the thread 15 is drawn out and the thread hook portion 43. In this case, the left end of the partition wall member 120 can be positioned between the thread 15 and the tensioner 45, including the slack center position. Therefore, at the time of sewing, the sewing machine 1 can more reliably inhibit the thread 15 from becoming entangled with the tensioner 45.

The radius R1 of the thread spool retainer 12 is smaller than the radius R2 of the inner peripheral surface 121A of the partition wall member 120. The thread 15 drawn out from the thread spool 13 is not clamped between the outer peripheral surface of the thread spool retainer 12 and the inner peripheral surface 121A of the partition wall member 120. As a result, the unintended tension is unlikely to be applied to the thread 15 and thus, the tension of the upper thread is unlikely to be affected at the time of sewing.

The partition wall member 120 can rotate around the axial line AX of the thread spool pin 100. When the thread spool 13 is mounted on and removed from the thread spool mounting portion 7, if the partition wall member 120 is rotated and the arrangement position is changed, the thread spool 13 is unlikely to collide with the partition wall member 120. Thus, the operator can easily mount and remove the thread spool 13.

The cross section, of the partition wall member 120, that is orthogonal to the axial line AX has the circular arc shape. Therefore, even when the partition wall member 120 rotates, there is no change in the size of the region occupied by the outer shape of the partition wall member 120 in the cross section including the axial line AX. Thus, the sewing machine 1 can be provided with the partition wall member 120 without increasing the size of the structure for securing the rotation radius of the partition wall member 120.

The operator can easily mount and remove the thread spool 13 by pressing the partition wall member 120 and disposing the partition wall member 120 in the second position. When the pressing of the partition wall member 120 is released, the partition wall member 120 returns to the first position due to the urging force of the spring 140. There is no need for the operator to manually return the partition wall member 120 to the first position, and it is thus possible to prevent the operator from forgetting to dispose the partition wall member 120 in the first position.

Various changes can be made to the above-described embodiment. The length in the circumferential direction of the inner peripheral surface 121A of the partition wall member 120 is not limited to approximately one-fourth of the length of the circumference of the virtual circle C2, and may be half or one-third of the length of the circumference of the virtual circle C2. The two openings 122 of the partition wall member 120 need not necessarily penetrate the main body portion 121. The cross section, of the partition wall member 120, that is orthogonal to the axial line AX need not necessarily have the circular arc shape, and may have a flat plate shape, for example. In this case, the flat plate is positioned between the tensioner 45 and the thread spool stand 130 due to the urging force, and by pressing and moving the flat plate downward, for example, the flat plate may be positioned below the rear end of the thread spool 13 so that the thread spool 13 can easily be removed. The partition wall member 120 may be a rod-like member that is a circular arc shape when viewed from the left side. In this case, the rod-like member may be rotatably disposed at the position of the left end of the partition wall member 120 of the present embodiment.

Figure 13:
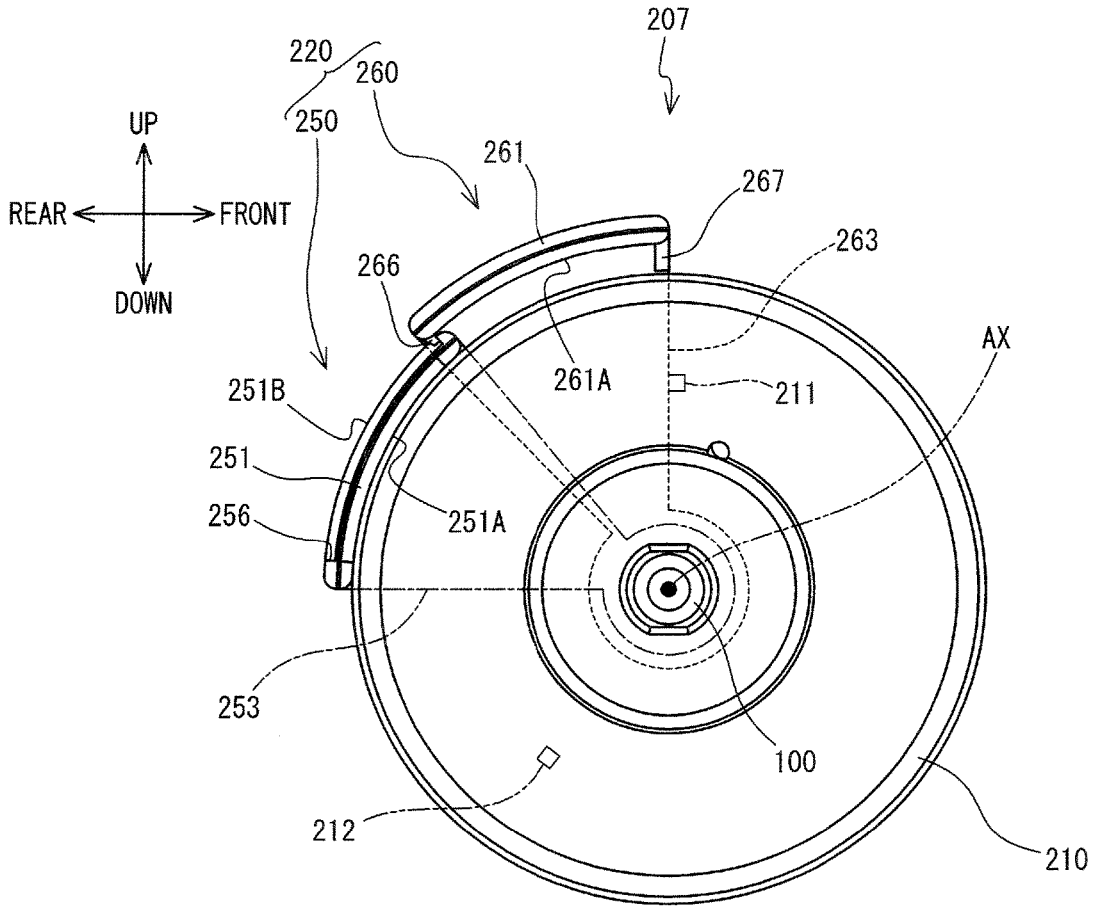
FIG. 13 is a left side view of a thread spool mounting portion when a second member is positioned in a third position.

For example, as shown by a thread spool mounting portion 207 in FIG. 13, a partition wall member 220 may be configured by two members, i.e., a first member 250 and a second member 260. The first member 250 and the second member 260 are formed in the following manner, for example. A main body portion 251 of the first member 250 is formed such that the length in the circumferential direction of an inner peripheral surface 251A is approximately one-eighth of the length of the circumference of a virtual circle along which the inner peripheral surface 251A extends. The diameter of the virtual circle along which the inner peripheral surface 251A of the first member 250 extends is made substantially the same as the diameter of a seat portion 210. A groove portion 256 that extends in the circumferential direction is formed in a left end portion of an outer peripheral surface 251B of the main body portion 251. A collar portion 253 of the first member 250 is formed in a plate shape that protrudes toward the axial line AX from the right end of the main body portion 251. The left surface of the collar portion 253 is disposed facing the right surface of the seat portion 210. The collar portion 253 is provided as a separate body from the seat portion 210. The collar portion 253 extends to a position of the axial line AX, and is provided such that the collar portion 253 engages with the outer periphery of the shaft portion 105 of the thread spool pin 100 and can rotate around the axial line AX.

A main body portion 261 of the second member 260 is formed such that the length in the circumferential direction of an inner peripheral surface 261A is approximately one-eighth of the length of the circumference of a virtual circle along which the inner peripheral surface 261A extends. The diameter of the virtual circle along which the inner peripheral surface 261A of the second member 260 extends is slightly larger than the diameter of a virtual circle along which the outer peripheral surface 251B of the first member 250 extends. A first protruding portion 266 that protrudes inwardly in the radial direction is formed on a left end portion of the inner peripheral surface 261A of the main body portion 261, i.e., on an end portion in the counterclockwise direction in a left side view of the inner peripheral surface 261A in the circumferential direction. Note that, in the present modified example, an explanation relating to the circumferential direction of the thread spool mounting portion 207 is an explanation when the thread spool mounting portion 207 is viewed from the left side. The first protruding portion 266 is engaged with the groove portion 256 of the first member 250. In the main body portion 261, a second protruding portion 267 that protrudes inwardly in the radial direction is formed on an end portion in the clockwise direction of the inner peripheral surface 261A in the circumferential direction. The second protruding portion 267 is provided at a position at which it comes into contact with an end portion in the clockwise direction of the first member 250 in the circumferential direction when the first member 250 and the second member 260 relatively move. A collar portion 263 of the second member 260 is formed in a plate shape that protrudes from the right end of the main body portion 261 toward the axial line AX. The left surface of the collar portion 263 is disposed facing the right surface of the collar portion 253 of the first member 250. The collar portion 263 is provided as a separate body from the seat portion 210. The collar portion 263 extends to a position of the axial line AX, and is provided such that the collar portion 263 engages with the outer periphery of the shaft portion 105 of the thread spool pin 100 and can rotate around the axial line AX. The collar portion 263 has a retaining hole (not shown in the drawings) that is engaged with the latching portion 141 of the spring 140 (refer to FIG. 4). The spring 140 urges the second member 260 in the clockwise direction relatively to the thread spool stand 130 (refer to FIG. 4). Note that the thread spool stand 130 may be fixed to the seat portion 210.

The right surface of the seat portion 210 has two locking portions 211 and 212 that protrude to the right, at positions that do not interfere with the arrangement position of the spring 140. The locking portion 211 is provided above the position of the axial line AX. The locking portion 212 is provided diagonally below and to the rear of the position of the axial line AX.

When no external stress is applied to the partition wall member 220, the second member 260 is urged by the spring 140 and rotates in the clockwise direction. The first protruding portion 266 of the second member 260 moves in the clockwise direction along the groove portion 256 of the first member 250. When the first protruding portion 266 comes into contact with an end portion in the clockwise direction of the groove portion 256, the first protruding portion 266 presses an inner surface of the groove portion 256 and rotates the first member 250 in the clockwise direction. As shown in FIG. 13, when the second member 260 moves to a "third position" in which an end portion of the collar portion 263 in the clockwise direction comes into contact with the locking portion 211 of the seat portion 210, the second member 260 stops the rotation. An end portion of the second member 260 in the clockwise direction is disposed above the axial line AX. An end portion of the first member 250 in the counterclockwise direction is disposed to the rear of the axial line AX. An end portion of the first member 250 in the clockwise direction and an end portion of the second member 260 in the counterclockwise direction are disposed in an overlapping manner in the radial direction of the axial line AX. The partition wall member 220 covers the section from the upper side to the rear side of the thread spool 13 (refer to FIG. 3), and is disposed between the tensioner 45 and the thread spool pin 100.

Figure 14:
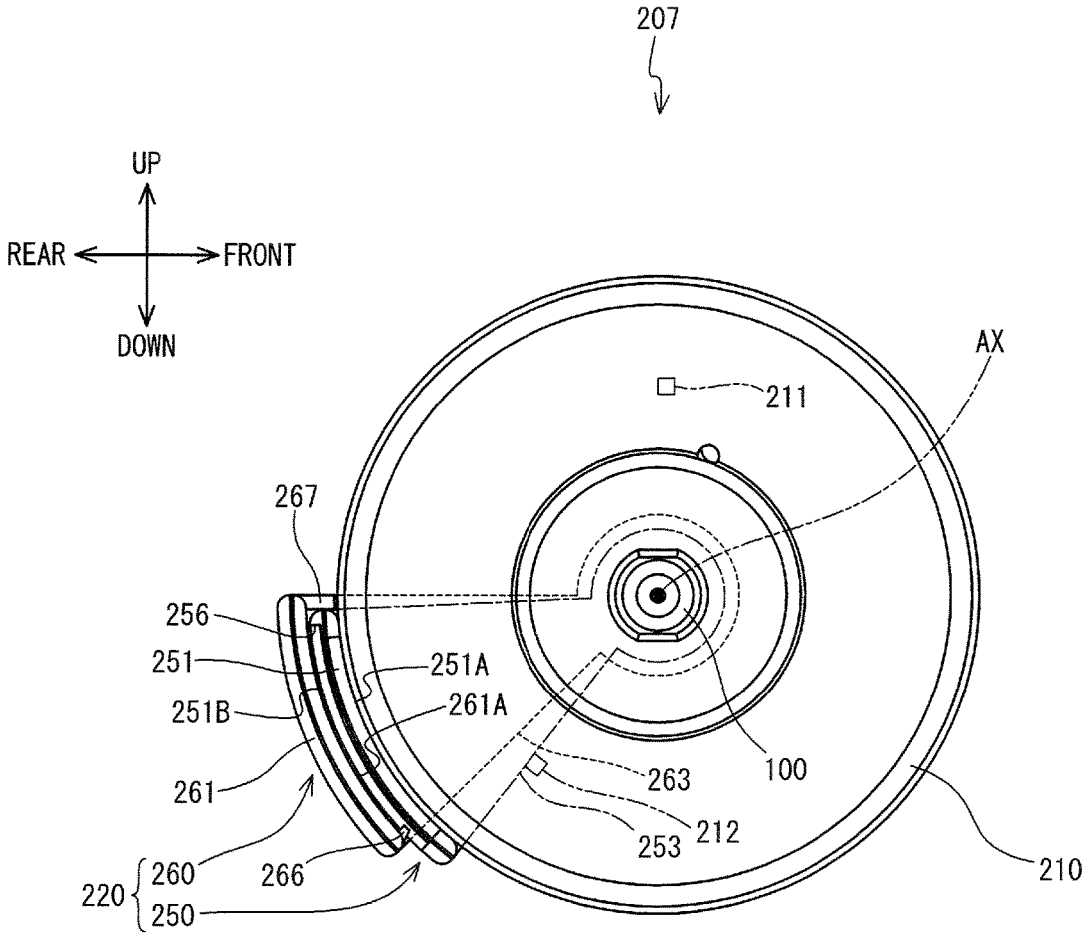
FIG. 14 is a left side view of the thread spool mounting portion when the second member is positioned in a fourth position.

When the main body portion 261 is pressed rearward and downward, the second member 260 rotates in the counterclockwise direction in resistance to the urging force of the spring 140. The first protruding portion 266 of the second member 260 moves in the counterclockwise direction along the groove portion 256 of the first member 250. When the second protruding portion 267 of the second member 260 comes into contact with the end portion of the first member 250 in the clockwise direction, the second protruding portion 267 presses the first member 250 in the counterclockwise direction. The first member 250 and the second member 260 rotate in the counterclockwise direction. As shown in FIG. 14, when the second member 260 moves to a "fourth position" in which an end portion in the counterclockwise direction of the collar portion 253 of the first member 250 comes into contact with the locking portion 212 of the seat portion 210, the second member 260 stops the rotation. The end portions of the first member 250 and the second member 260 in the clockwise direction are disposed to the rear of the axial line AX. The end portions of the first member 250 and the second member 260 in the counterclockwise direction are disposed diagonally below and to the rear of the axial line AX. When the second member 260 is positioned in the fourth position, the overlap of the first member 250 and the second member 260 in the radial direction of the axial line AX is larger than when the second member 260 is positioned in the third position. When the operator mounts and removes the thread spool 13, since the second member 260 is positioned in the fourth position, the thread spool 13 can be significantly exposed. Thus, the operator can easily mount and remove the thread spool 13.

Figure 15:
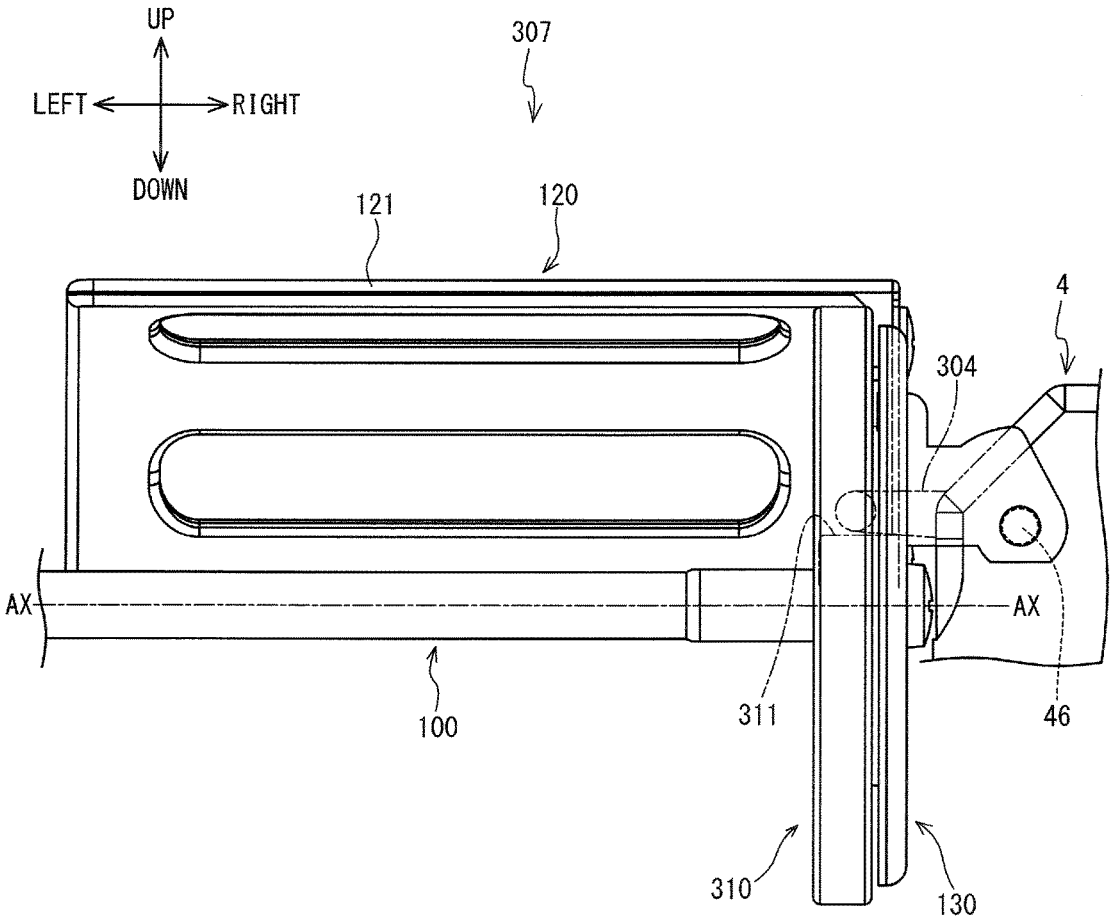
FIG. 15 is a front view of a thread spool mounting portion when the thread spool mounting portion is positioned in a fifth position.

For example, as shown by a thread spool mounting portion 307 in FIG. 15, the partition wall member 120 may be structured such that, for example, the partition wall member 120 rotates around the axial line AX in accordance with the operation of mounting and removing the thread spool 13. The thread spool mounting portion 307 is structured in the following manner. On the right surface of a seat portion 310, an engagement portion 311 is formed to the right of the position of the axial line AX. The engagement portion 311 is formed in a concave shape. The engagement portion 311 is provided in a position where the engagement portion 311 does not interfere with the collar portion 123 of the partition wall member 120 and also does not interfere with the thread spool stand 130. An engagement protrusion 304 is formed on the top surface of the arm portion 4 of the sewing machine 1, in a section where the thread spool mounting portion 307 is provided. The engagement protrusion 304 is provided to the side of the shaft rod 46, substantially at the same position as the shaft rod 46 in the up-down direction, and protrudes to the left. In a state in which the thread spool mounting portion 307 is assembled on the sewing machine 1, a leading end portion of the engagement protrusion 304 is disposed inside the engagement portion 311 of the seat portion 310. The partition wall member 120 is urged by the spring 140 and is disposed in the first position. The thread spool mounting portion 307 is disposed in the fifth position in which the axial line AX extends in the left-right direction.

When the thread spool 13 is mounted and removed, the operator lifts the leading end portion 101 of the thread spool pin 100 upward, for example. The thread spool mounting portion 307 rotates around the axial center of the shaft rod 46 in the clockwise direction in a front view. The axial line AX intersects with the left-right direction. In accordance with the rotation of the thread spool mounting portion 307, the engagement portion 311 moves upward and comes into contact with the leading end portion of the engagement protrusion 304. Since the thread spool mounting portion 307 rotates in the clockwise direction in a front view, the engagement protrusion 304 presses the engagement portion 311 relatively downward. Since the engagement portion 311 positioned to the right of the axial line AX in a right side view is pressed relatively downward, the seat portion 310 rotates in the counterclockwise direction in a left side view in resistance to the urging force of the spring 140. In accordance with the rotation of the seat portion 310, the main body portion 121 of the partition wall member 120 rotates around the axial line AX in the counterclockwise direction in a left side view.

Figure 16:
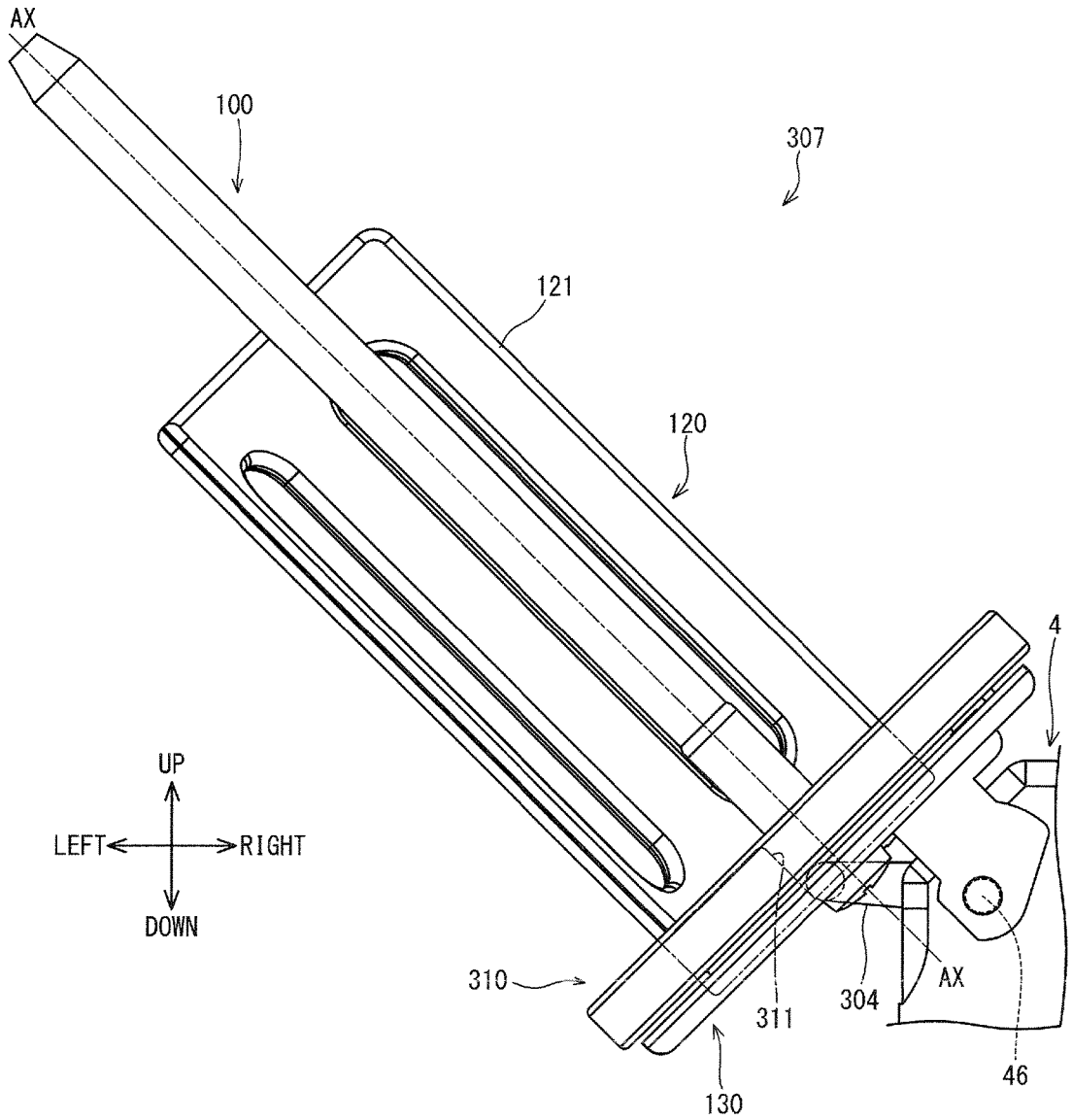
FIG. 16 is a front view of the thread spool mounting portion when the thread spool mounting portion is positioned in a sixth position.

As shown in FIG. 16, when the thread spool mounting portion 307 is disposed in the sixth position, the partition wall member 120 is disposed in the second position. The main body portion 121 is orthogonal to the axial line AX, and is mainly positioned below the axial line AX in the direction orthogonal to the axial center of the shaft rod 46. The partition wall member 120 exposes the thread spool 13 in a plan view. In this manner, when the thread spool mounting portion 307 rotates from the fifth position to the sixth position, the leading end portion 101 of the thread spool pin 100 is disposed above the base end portion 102. Therefore, the operator can easily mount and remove the thread spool 13. Further, since the partition wall member 120 rotates from the first position to the second position in conjunction with the rotation of the thread spool mounting portion 307, the operator can more easily mount and remove the thread spool 13.

The apparatus described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

an arm portion internally provided with a drive shaft extending in a first direction;

a thread spool mounting portion provided on the arm portion and including a thread spool pin configured to be inserted through a through hole of a thread spool around which a thread is wound, the thread spool being mounted on the thread spool mounting portion, the thread spool mounting portion including a thread spool stand configured to fix one end portion of the thread spool pin;

a bobbin winder provided further to one end side in the first direction of the arm portion than the thread spool mounting portion, and configured to wind the thread drawn out from the thread spool onto a bobbin;

a tensioner provided further to another end side in the first direction of the arm portion than the thread spool mounting portion, configured to apply a tension to the thread drawn out from the thread spool, and configured to supply the thread drawn out from the thread spool to the bobbin winder;

a thread hook portion provided further to the another end side in the first direction of the arm portion than the tensioner, and configured to guide the thread drawn out from the thread spool, which is to be supplied to a sewing needle mounted on a needle bar that is configured to move up and down in accordance with rotation of the drive shaft; and a partition wall member provided on the thread spool stand and disposed between the thread spool pin and the tensioner in a second direction that is orthogonal to the first direction.

2. The sewing machine according to claim 1, wherein the partition wall member extends from the thread spool stand along an extending direction of the thread spool pin.

3. The sewing machine according to claim 1, wherein a disc-shaped thread spool retainer is configured to be mounted on the thread spool mounting portion, the thread spool retainer being configured to hold the thread spool in a state in which the thread spool pin is inserted through the through hole, and the partition wall member is disposed between the thread spool pin and the tensioner, further to the outside in a radial direction of the thread spool pin than an outer peripheral edge portion of the thread spool retainer.

4. The sewing machine according to claim 1, wherein the partition wall member is configured to rotate around an axis of the thread spool pin.

5. The sewing machine according to claim 4, wherein the partition wall member is a plate-shaped member whose axial cross section has a circular arc shape around the axis of the thread spool pin.

6. The sewing machine according to claim 4, wherein the partition wall member is configured to rotate between a first position and a second position, the first position being a position of the partition wall member between the thread spool pin and the tensioner, and the second position being a position of the partition wall member at which exposure of the thread spool is larger than that in the first position in a plan view of the sewing machine, and the sewing machine further comprises an urging member configured to urge the partition wall member from the second position toward the first position.

7. The sewing machine according to claim 1, wherein the partition wall member includes:

a first member configured to be disposed between the thread spool pin and the tensioner; and a second member configured to rotate around an axis of the thread spool pin, and configured to rotate between a third position and a fourth position, the third position being a position of the second member positioned between the thread spool pin and the tensioner in a state in which an end portion of the first member and an end portion of the second member overlap with each other in a radial direction of the thread spool pin, and the fourth position being a position of the second member at which exposure of the thread spool is larger than that in the third position in a plan view of the sewing machine, in a state in which the overlap of the first member and the second member is larger than in the third position.

8. The sewing machine according to claim 1, wherein the thread spool mounting portion is configured to rotate between a fifth position and a sixth position, the fifth position being a position of the thread spool mounting portion in which an extending direction of the thread spool pin is along the first direction, and the sixth position being a position of the thread spool mounting portion in which the extending direction of the thread spool pin intersects with the first direction, the partition wall member is configured to rotate between a first position and a second position, the first position being a position of the partition wall member between the thread spool pin and the tensioner, and the second position being a position of the partition wall member at which exposure of the thread spool is larger than that in the first position in a plan view of the sewing machine, the sewing machine further comprises a transmission portion configured to be in contact with the thread spool mounting portion, and configured to transmit a driving force generated by rotation of the thread spool mounting portion to the partition wall member, and the partition wall member is positioned in the first position when the thread spool mounting portion is positioned in the fifth position, rotates from the first position toward the second position due to the driving force transmitted by the transmission portion when the thread spool mounting portion rotates from the fifth position to the sixth position, and is positioned in the second position when the thread spool mounting portion is positioned in the sixth position.

* * * * *